US010632607B2

(12) United States Patent
Aguilar

(10) Patent No.: US 10,632,607 B2
(45) Date of Patent: Apr. 28, 2020

(54) TOOL STORAGE ASSEMBLY

(71) Applicant: Jorge Aguilar, Coquitlam (CA)

(72) Inventor: Jorge Aguilar, Coquitlam (CA)

( * ) Notice: Subject to any disclaimer, the term of this patent is extended or adjusted under 35 U.S.C. 154(b) by 0 days.

(21) Appl. No.: 16/118,369

(22) Filed: Aug. 30, 2018

(65) Prior Publication Data

US 2019/0143502 A1 May 16, 2019

Related U.S. Application Data

(60) Provisional application No. 62/553,388, filed on Sep. 1, 2017.

(51) Int. Cl.
*B25H 3/04* (2006.01)
*E04F 21/16* (2006.01)

(52) U.S. Cl.
CPC ..... *B25H 3/04* (2013.01); *E04F 21/161* (2013.01)

(58) Field of Classification Search
CPC ..... B25H 3/04; B25H 3/006; E04F 21/161
See application file for complete search history.

(56) References Cited

U.S. PATENT DOCUMENTS 1,661,121 A * 2/1928 Huson ..... B25H 3/02 206/372
3,315,816 A * 4/1967 Mallory ..... B25H 3/04 211/70.6
4,966,288 A * 10/1990 Kirkham ..... B25H 3/04 211/13.1
5,411,191 A * 5/1995 Bunn, Jr. ..... A47F 7/0021 211/70.6
5,566,841 A * 10/1996 Evans ..... B25H 3/04 211/70.6
7,077,275 B2 * 7/2006 Kao ..... A47F 7/0028 206/372
7,080,733 B2 * 7/2006 Kao ..... B25H 3/04 206/372
7,100,777 B1 * 9/2006 Kao ..... A47F 5/0807 206/372
7,703,638 B2 * 4/2010 Magnani ..... B25C 3/00 221/165
9,056,756 B1 * 6/2015 De Marco ..... A47G 25/0614
10,213,915 B1 * 2/2019 DeMarco ..... B25H 3/04
10,392,817 B2 * 8/2019 Gross ..... E04F 21/1805
2004/0040917 A1 * 3/2004 Lopinto ..... B25H 3/00 211/70.6
2007/0056918 A1 * 3/2007 Laga ..... B25H 3/04 211/41.1
2008/0179265 A1 * 7/2008 Lin ..... A47F 7/0028 211/70.6
2010/0163502 A1 * 7/2010 Chang ..... B25H 3/04 211/70.6

(Continued)

FOREIGN PATENT DOCUMENTS

DE 29700265 U1 * 4/1997 ..... B25H 3/00
DE 10253338 B3 * 6/2004 ..... B25H 3/04
DE 10355787 A1 * 6/2005 ..... B25H 3/04

(Continued)

*Primary Examiner* — Stanton L Krycinski
(74) *Attorney, Agent, or Firm* — David W Barman

(57) ABSTRACT

A tool carrying assembly includes at least one main assembly frame; a base, constructed and arranged to support said main frame; and at least one structure configured for storing a tool on said assembly.

4 Claims, 2 Drawing Sheets

(56) References Cited

U.S. PATENT DOCUMENTS

| | | | | |
|---|---|---|---|---|
| 2017/0001299 | A1* | 1/2017 | Chu | B25H 3/06 |

FOREIGN PATENT DOCUMENTS

| | | | | |
|---|---|---|---|---|
| DE | 202013003169 | U1 * | 4/2013 | B25H 3/04 |
| DE | 202014102518 | U1 * | 6/2015 | A47F 7/0028 |
| DE | 202015006635 | U1 * | 11/2015 | B25H 3/04 |
| FR | 1328288 | A * | 5/1963 | B25H 3/04 |
| FR | 2495531 | A1 * | 6/1982 | A47G 21/14 |

* cited by examiner

TOOL STORAGE ASSEMBLY

INDEX TO RELATED APPLICATIONS

This application is a non-provisional of and claims benefit to U.S. Provisional Patent Application Ser. No. 62/553,388 Filed Sep. 1, 2017 the disclosure of which is incorporated herein by reference in its entirety.

BACKGROUND OF THE INVENTION

The skilled artisan, the novice handyman, and everyone in between each have one basic requirement. They each require a way to safely and efficiently carry the tools of their trade. All too often, a person will reach into a toolbox and encounter an unwanted sharp object. This could be pliers, a screwdriver, or a blade for cutting. There is a need to safely and efficiently arrange tools in a toolbox to protect both the tools and the user. The present invention addresses this need.

SUMMARY OF THE INVENTION

In one embodiment, the present invention is a tool carrying assembly, said assembly comprising:

at least one main frame;

a base, constructed and arranged to support said main frame; and at least one structure configured for storing a tool on said assembly.

In one embodiment, the structure configured for storing a tool on said assembly is a storage support arm.

In one embodiment, the assembly includes a first storage support arm, a second storage support arm, and a tool storage cavity there between.

In one embodiment, the assembly further includes at least one securing means for securing a tool to said assembly.

In one embodiment, the frame is permanently attached to said base.

In one embodiment, the frame is removably attached to said base.

In one embodiment, the present invention is a tool carrying assembly, said assembly consisting essentially of:

at least one main frame;

a base, constructed and arranged to support said main frame; and a first storage support arm, a second storage support arm, and a tool storage cavity there between;

a tool storage cavity there between; and at least one securing means for securing a tool to said assembly.

The invention also contemplates a method of carrying tools, said method having the steps of:

providing an assembly as described herein;

placing at least one tool on said assembly;

placing said assembly in a tool box.

DETAILED DESCRIPTION OF THE PREFERRED EMBODIMENT

Figure 1:
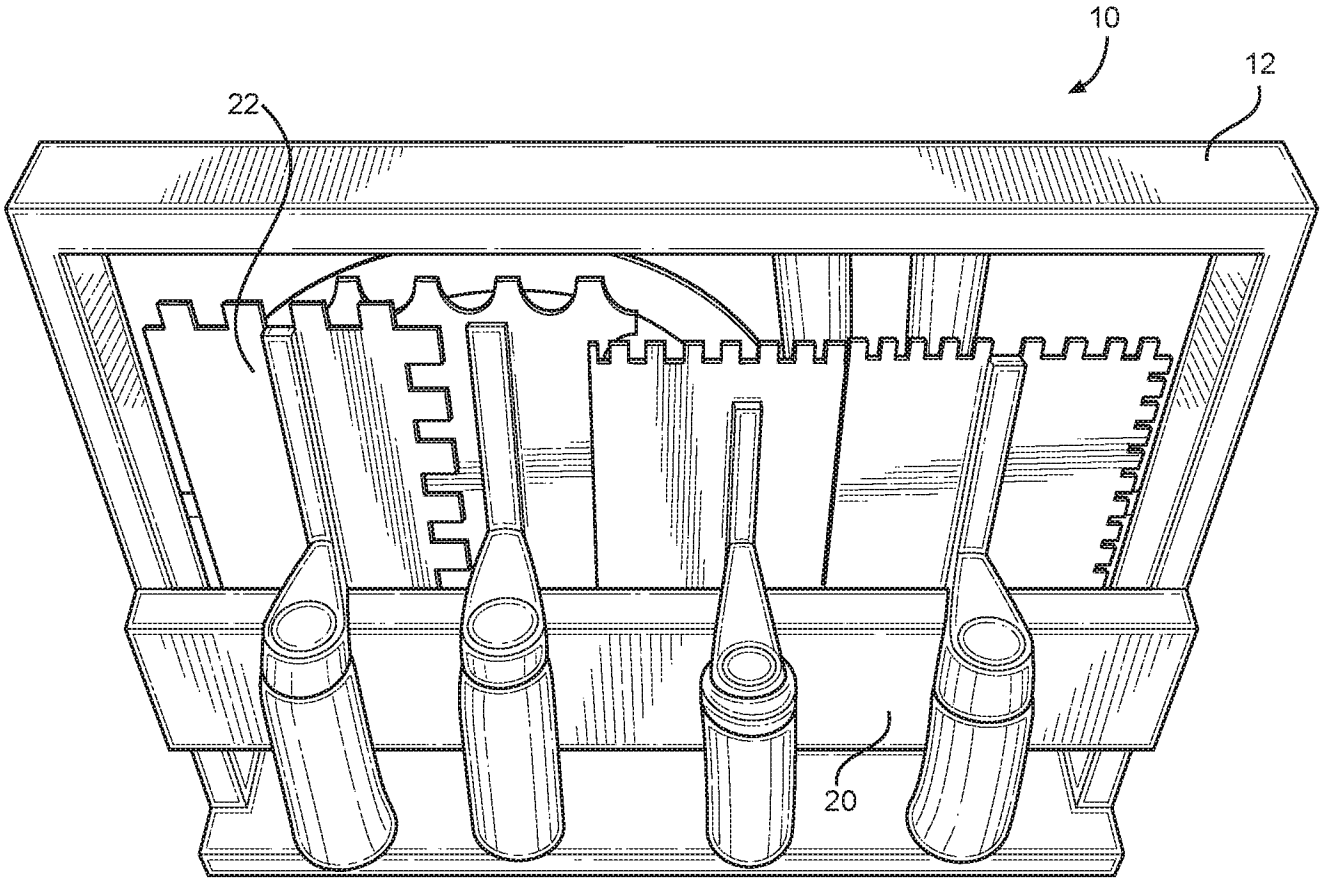
FIG. 1 is a front perspective view demonstrative of one embodiment of the present invention.
Figure 2:
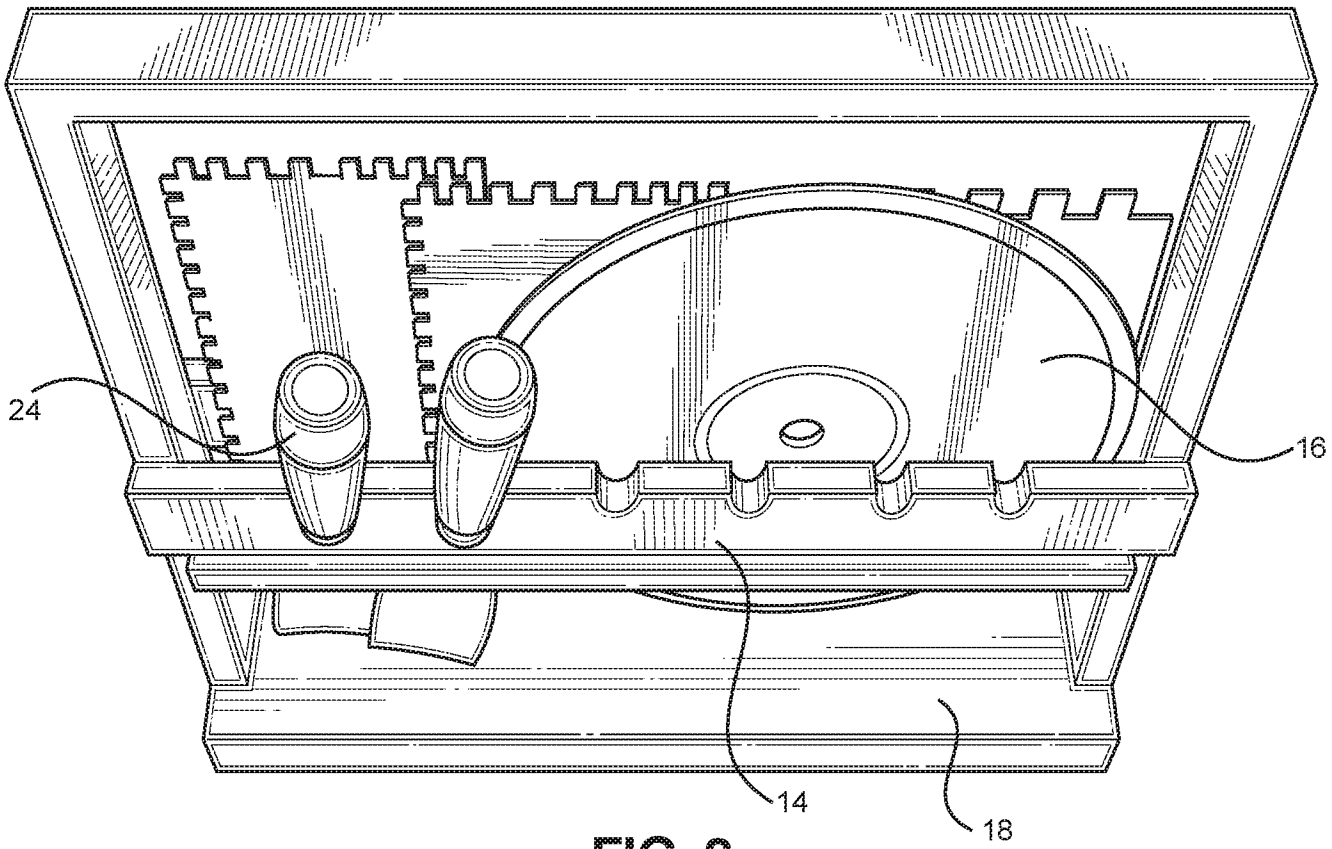
FIG. 2 is a front perspective view demonstrative of one embodiment of the present invention.

As toolboxes are generally rectangular cubicle solids and configuration is advantageous to provide a system configured with a similar geometric shape. Although the figures presented herein demonstrate one embodiment, it is contemplated that the present invention includes variations for various pool box configurations.

Assembly 10 includes a central frame 12 that is associated with a base 18. In this embodiment, a user will stand base 18 on a floor, table, or other substantially level flat surface, and arrange tools to be held by assembly 10. In one embodiment, a first tool support 14 is constructed and arranged to receive at least one first tool 24. A second tool support 20 is constructed and arranged to receive second tool 22. Frame 12 is constructed and arranged to receive at least one tool placed with an the boundary of first tool support 14 and second will support 20. In the embodiment demonstrated, a cutting wheel 16 is stored and secured within frame 12. Although they are not specifically demonstrated in the embodiments presented herein, the present invention further contemplates one or more structures to secure tools into a fixed position within assembly 10. Each of the first tool support 14 and second pool support 20 is demonstrated herein with a series of notches constructed and arranged to hold handtools in a fixed position when assembly 10 is in an upright position. Further contemplated are any other securing means and mechanisms that will keep pools stored and transported with an assembly 10 from moving.

It is contemplated that assembly can be placed within a larger total box (not shown) and transported as needed. When a worker is in need of a particular tool, they will open the toolbox, remove the entire assembly 10, and select a desired tool. Once a worker is finished with the desired tool, they will return the tool to its position with an assembly 10, and ultimately return assembly 10 back into the toolbox for further storage and/or transportation.

It is further contemplated in the present invention that in an embodiment including securing means for securing tools in assembly 10, a user will remove assembly 10 from a toolbox, release one or more securing means in order to access a desired tool, use the designer tool, return the desired tool to its position in assembly 10, secured with the securing means, and finally return assembly 10 to the interior of a toolbox.

As seen from the embodiments demonstrated herein, sharp objects and edges are contained with in the interior of assembly 10 plus keeping them away from inadvertent contact.

Interior, as used herein, refers to that interior cavity area defined by each of first storage support arm 14 and second storage support arm 22.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A tool carrying assembly, said assembly consisting of:

a single main frame;

a base, constructed and arranged to support said single main frame; and a first tool support on one side of said single main frame and a second tool support on a side opposite said first tool support, each of said first tool support and second tool support define a cavity therebetween with said main frame, wherein said second tool support is constructed with a plurality of u-shaped notches constructed and arranged to hold hand tools in a fixed position when said main frame is in an upright position, each of said a first tool support and second tool support positioning supported tools with handles positioned and accessible outside said main frame, wherein said cavity is constructed and arranged to store cutting wheels in said cavity between each of said first tool support and second tool support.

2. The assembly of claim 1 wherein said single main frame is permanently attached to said base.

3. The assembly of claim 1 wherein said single main frame is removably attached to said base.

4. A method of carrying tools, said method having the steps of:

providing an assembly of claim 1;

placing at least one tool on said assembly;

placing said assembly in a tool box.

* * * * *